US012379127B2

(12) United States Patent
Kuppusamy et al.

(10) Patent No.: US 12,379,127 B2
(45) Date of Patent: Aug. 5, 2025

(54) AIR INTAKE AND DISCHARGE SEALING STRUCTURES FOR EVAPORATOR UNITS

(71) Applicant: HEATCRAFT REFRIGERATION PRODUCTS LLC, Stone Mountain, GA (US)

(72) Inventors: Karthick Kuppusamy, Salem (IN); Vinothraj Thangarathinam, Chennai (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 324 days.

(21) Appl. No.: 18/069,415

(22) Filed: Dec. 21, 2022

(65) Prior Publication Data

US 2024/0210067 A1 Jun. 27, 2024

(51) Int. Cl.

| | |
|---|---|
| ***F24F 11/65*** | (2018.01) |
| ***F24F 13/14*** | (2006.01) |
| ***F24F 13/20*** | (2006.01) |
| ***F25B 39/02*** | (2006.01) |

(52) U.S. Cl.

CPC ..... *F24F 11/65* (2018.01); *F24F 13/14* (2013.01); *F24F 13/20* (2013.01); *F25B 39/02* (2013.01)

(58) Field of Classification Search

CPC . F24F 11/65; F24F 13/14; F24F 13/20; F25B 39/02

See application file for complete search history.

(56) References Cited

U.S. PATENT DOCUMENTS

2018/0100671 A1* 4/2018 Snider ..... F24F 11/72
2022/0003484 A1* 1/2022 Kuppusamy ..... F25D 13/00

FOREIGN PATENT DOCUMENTS

JP 2004125194 A * 4/2004

* cited by examiner

*Primary Examiner* — Kun Kai Ma
(74) *Attorney, Agent, or Firm* — Baker Botts L.L.P.

(57) ABSTRACT

A controller is configured to operate a heating, ventilation, and air conditioning (HVAC) system and to actuate sealing structures coupled to an evaporator unit, wherein the sealing structures are configured to prevent airflow from interacting with an evaporator coil during a defrost cycle. The controller is configured to determine if the HVAC system is transitioning from a first mode of operation to a second mode of operation, wherein the second mode is a defrost cycle. In response to determining that the HVAC system is transitioning from the first mode of operation to the second mode of operation, the controller is configured to actuate a first actuator to move a first sealing structure to a second position, wherein the second position is configured to seal an air intake side of a housing of the evaporator unit.

19 Claims, 9 Drawing Sheets

AIR INTAKE AND DISCHARGE SEALING STRUCTURES FOR EVAPORATOR UNITS

TECHNICAL FIELD

The present disclosure relates generally to heating, ventilation, and air conditioning (HVAC) system control, and more specifically to air intake and discharge sealing structures for evaporator units.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. During operation, ice and frost can build-up on certain metallic components in the HVAC system. A defrost cycle can be implemented to reduce the ice and frost build-up.

SUMMARY

The system disclosed in the present application provides a technical solution to the technical problems discussed above by preventing one or more evaporator coils from interacting with ambient air that is at a lower temperature than the evaporator coils during a defrost cycle. The disclosed system provides several practical applications and technical advantages which include a process that enables an HVAC system to determine when the HVAC system is transitioning to a defrost cycle, transition sealing structures from a first position to a second position to prevent ambient air from interacting with the one or more evaporator coils, and performing a defrost cycle. These features reduce the amount of time and power consumption that an HVAC system will experience during a defrost cycle because the HVAC system is able to apply heat to the evaporator coils without the effects of heat being transferred to the ambient air due to its lower temperature. As such, the disclosed system can further increase the efficiency of defrost cycles.

In one embodiment, the system comprises an evaporator unit comprising a housing configured to contain an evaporator coil, the housing comprising an air intake side and an air discharge side. The evaporator unit further comprises a first sealing structure disposed along the housing and a first actuator coupled to the first sealing structure and operable to move the first sealing structure between a first position and a second position. The evaporator unit further comprises the evaporator coil configured to receive an airflow and to transfer heat from the received airflow to a flow of refrigerant and a fan disposed downstream of the evaporator coil configured to introduce the airflow into the housing. The system further comprises a compressor configured to receive the flow of refrigerant from the evaporator coil and to discharge the flow of refrigerant at a higher pressure. The system further comprises a condensing unit comprising a condenser configured to receive the flow of refrigerant from the compressor and to reduce a temperature of the flow of refrigerant. The system further comprises a controller operably coupled to the evaporator unit. The controller comprises a processor configured to determine if the HVAC system is transitioning from a first mode of operation to a second mode of operation, wherein the first sealing structure is in the first position during the first mode of operation. In response to determining that the HVAC system is transitioning from the first mode of operation to the second mode of operation, the processor is configured to actuate the first actuator to move the first sealing structure to the second position, wherein the second position is configured to seal the air intake side of the housing. During the second mode of operation, the compressor and the fan are each turned off.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Cooling systems cycle refrigerant to cool various spaces. For example, a heating, ventilation, and air conditioning (HVAC) system cycles refrigerant to cool spaces near or around air conditioner loads. These loads include metal components, such as coils, that carry the refrigerant. As the refrigerant passes through these metallic components, frost and/or ice may accumulate on the exterior of these metallic components. The ice and/or frost reduces the efficiency of the load. For example, as frost and/or ice accumulates on a load, it may become more difficult for the refrigerant within the load to absorb heat that is external to the load.

One way to address frost and/or ice accumulation on the load is to perform a defrost cycle. The defrost cycle may include a period of time in which the HVAC system is shut off and the ice and/or frost is allowed to thaw. The defrost cycle may be performed to naturally thaw the ice and/or frost or may induce thawing through the use of an electrical heater or through hot gas defrost. As such, it may take time to perform a defrost cycle to remove any ice and/or frost.

This disclosure contemplates an unconventional cooling system that prevents ambient air from contacting the evaporator coils in an evaporator unit during a defrost cycle. As the cooling system transitions from a refrigeration cycle to a defrost cycle, the cooling system may seal the evaporator unit from surrounding ambient air. In an example, at the time of transition, the temperature of the ambient air proximate to the evaporator unit may be lower than the temperature of the evaporator coils. As the defrost cycle begins and heat is applied to the evaporator coils, the lower temperature of the ambient air may increase the time and the power consumption needed to defrost the evaporator coils. This disclosure contemplates using one or more sealing structures to seal the evaporator unit prior to performing the defrost cycle, thereby preventing ambient air to contact the evaporator coils and reducing the power consumption and time needed to defrost the evaporator coils. The cooling system will be described using FIGS. 1 through 6, wherein FIG. 1 will describe the overall, improved cooling system, and FIGS. 2-6 will describe the configuration and operation of the evaporator unit within the cooling system in further detail.

Figure 1:
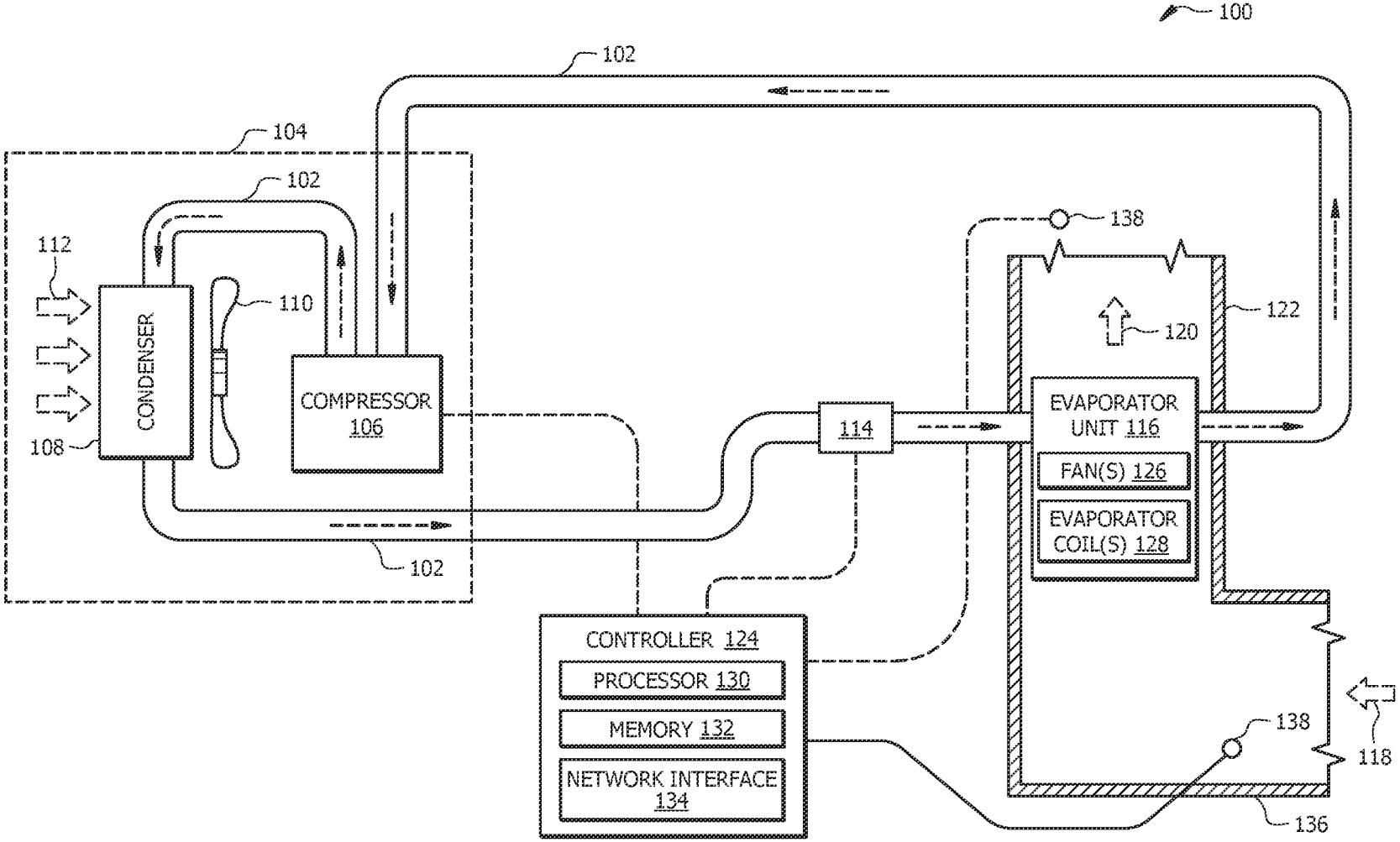
FIG. 1 is a schematic diagram of an embodiment of an HVAC system.

FIG. 1 is a schematic diagram of an embodiment of a HVAC system 100 configured to perform an efficient defrost cycle during a second mode of operation. The HVAC system 100 is generally configured to perform cooling and/or heat pump cycles. The HVAC system 100 conditions air for delivery to an interior space of a building or home. The HVAC system 100 is generally configured to control the temperature of a space. Examples of a suitable space may include, but are not limited to, a room, a home, an apartment, a mall, an office, a warehouse, or a building. In embodiments, the HVAC system 100 may be a rooftop unit (RTU) that is positioned on the roof of a building and the conditioned air is delivered to the interior of the building. In other embodiments, portions of the system may be located within the building and a portion outside the building. The HVAC system 100 may also include heating elements that are not shown here for convenience and clarity. The HVAC system 100 may be configured as shown in FIG. 1 or in any other suitable configuration. For example, the HVAC system 100 may include additional components or may omit one or more components shown in FIG. 1. The HVAC system 100 may comprise a controller or thermostat, compressors, blowers, evaporators, condensers, and/or any other suitable type of hardware for controlling the temperature of the space. Although FIG. 1 illustrates a single HVAC system 100, a location or space may comprise a plurality of HVAC systems 100 that are configured to work together. For example, a large building may comprise multiple HVAC systems 100 that work cooperatively to control the temperature within the building.

The HVAC system 100 may comprise a working-fluid conduit subsystem 102 for moving a working fluid, or refrigerant, through a cooling cycle. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), or any other suitable type of refrigerant.

The HVAC system 100 may comprise one or more condensing units 104. In one embodiment, the condensing unit 104 comprises a compressor 106, a condenser coil 108, and a fan 110. The compressor 106 is coupled to the working-fluid conduit subsystem 102 that compresses the working fluid. The condensing unit 104 may be configured with a single-stage or multi-stage compressor 106 or with multiple compressors. In the configuration of one or more compressors, the one or more compressors can be turned on or off to adjust the cooling capacity of the HVAC system 100. In some embodiments, a compressor 106 may be configured to operate at multiple speeds or as a variable speed compressor. For example, the compressor 106 may be configured to operate at multiple predetermined speeds.

The condenser 108 is configured to assist with moving the working fluid through the working-fluid conduit subsystem 102. The condenser 108 is located downstream of the compressor 106 for rejecting heat. The fan 110 is configured to move air 112 across the condenser 108. For example, the fan 110 may be configured to blow outside air through the heat exchanger to help cool the working fluid. The fan 110 may be coupled to a motor, wherein the motor may be configured to actuate the fan 110.

With reference back to the flow of the working fluid, the compressed, cooled working fluid flows downstream from the condenser 108 to an expansion device 114, or a metering device. The expansion device 114 is configured to remove pressure from the working fluid. The expansion device 114 is coupled to the working-fluid conduit subsystem 102 downstream of the condenser 108 for removing pressure from the working fluid prior to flowing to an evaporator unit 116. The expansion device 114 may be closely associated with the evaporator unit 116. In this way, the working fluid is delivered to the evaporator unit 116 and receives heat from airflow 118 to produce a treated airflow 120 that is delivered by a duct subsystem 122 to the desired space, for example, a room in the building.

In an embodiment, the evaporator unit 116 may be in signal communication with a controller 124 using a wired or wireless connection. The controller 124 may be configured to provide commands or signals to control the operation of the evaporator unit 116. An example of the controller 124 in operation is described further below in FIG. 6. For example, the controller 124 is configured to send signals to turn on or off one or more fans 126 to facilitate airflow over one or more evaporator coils 128 contained within the evaporator unit 116. The one or more fans 126 may be disposed upstream and/or downstream of the one or more evaporator coils 128. In another example, the controller 124 may be configured to actuate one or more sealing structures (for example, first sealing structure 400 in FIGS. 4A-4C and second sealing structure 500 in FIGS. 5A-5B) to transition from a first position to a second position to close off the evaporator unit 116 from ambient air. In this example, the controller 124 may transmit instructions to the evaporator unit 116 based on a determination that the HVAC system 100 is transitioning from a first mode of operation, such as a refrigeration cycle, to a second mode of operation, wherein the second mode of operation is a defrost cycle.

As an example, the controller 124 may comprise a processor 130, a memory 132, and a network interface 134. In embodiments, the controller 124 may further comprise a graphical user interface, a display, a touch screen, buttons, knobs, or any other suitable combination of components. The controller 124 may be configured as shown or in any other suitable configuration.

The processor 130 comprises one or more processors operably coupled to the memory 132. The processor 130 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The processor 130 may be a programmable logic device, a microcontroller, a microprocessor, or any suitable combination of the preceding. The processor 130 is communicatively coupled to and in signal communication with the memory 132 and the network interface 134. The one or more processors may be configured to process data and may be implemented in hardware or software. For example, the processor 130 may be 8-bit, 16-bit, 32-bit, 64-bit, or of any other suitable architecture. The processor 130 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The one or more processors are configured to implement and execute various instructions. The instructions may comprise any suitable set of instructions, logic, rules, or code operable to be executed. In this way, processor 130 may be a special-purpose computer designed to implement the functions disclosed herein.

Figure 6:
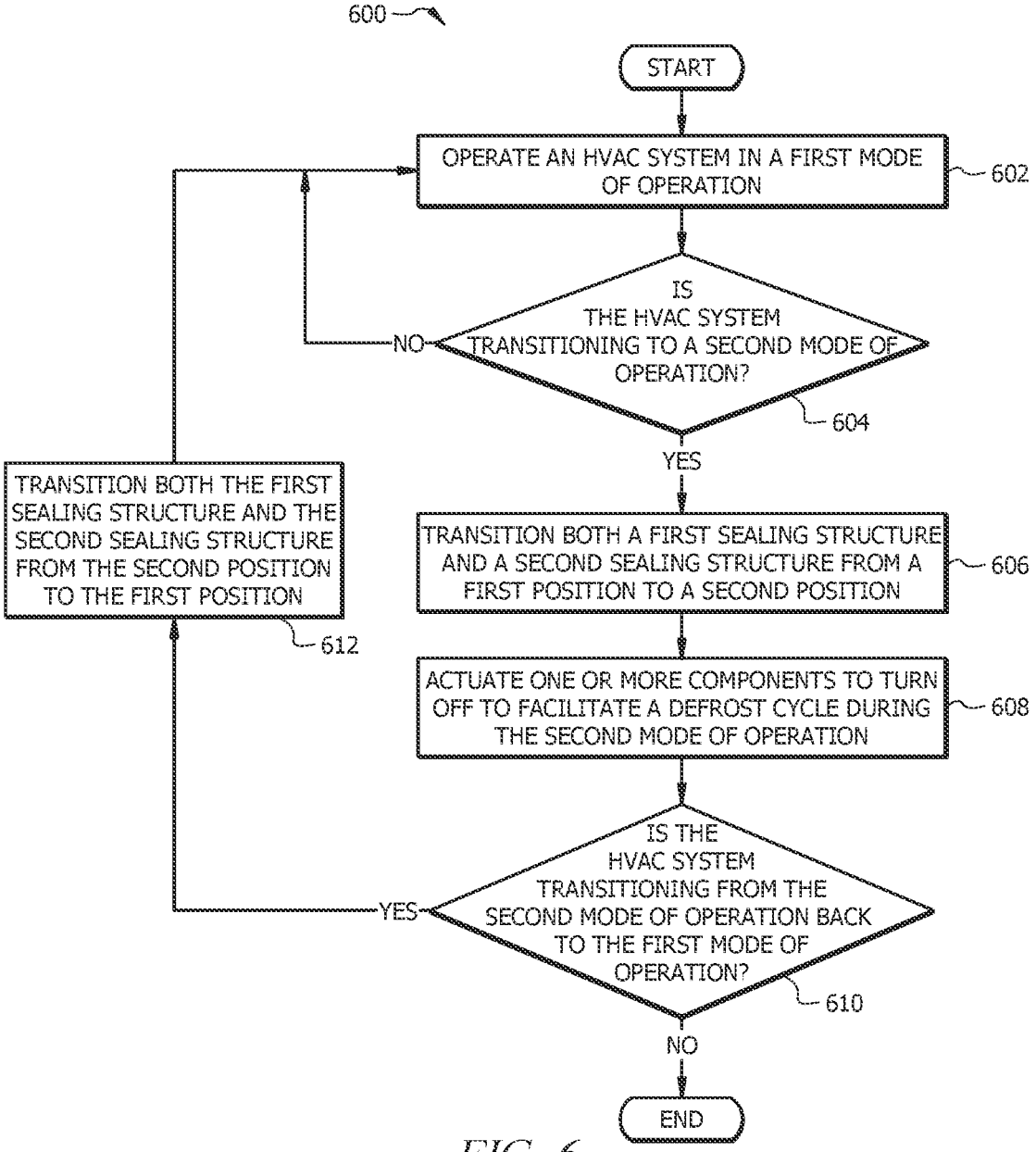
FIG. 6 is a flowchart of an example process for the HVAC system of FIG. 1.

The memory 132 is operable to store any of the information described with respect to FIGS. 1 and 6 along with any other data, instructions, logic, rules, or code operable to implement the function(s) described herein when executed by the processor 130. The memory 132 comprises one or more disks, tape drives, or solid-state drives, and may be used as an over-flow data storage device, to store programs when such programs are selected for execution, and to store instructions and data that are read during program execution. The memory 132 may be volatile or non-volatile and may comprise a read-only memory (ROM), random-access memory (RAM), ternary content-addressable memory (TCAM), dynamic random-access memory (DRAM), and static random-access memory (SRAM).

The network interface 134 is configured to enable wired and/or wireless communications. The network interface 134 is configured to communicate data between the thermostat 104 and other devices (e.g. sound sensors 106 and the HVAC system 100), systems, or domains. For example, the network interface 134 may comprise an NFC interface, a Bluetooth interface, a Zigbee interface, a Z-wave interface, an RFID interface, a WIFI interface, a LAN interface, a WAN interface, a PAN interface, a modem, a switch, or a router. The processor 130 may be configured to send and receive data using the network interface 134. The network interface 134 may be configured to use any suitable type of communication protocol as would be appreciated by one of ordinary skill in the art.

In further embodiments, controller 124 may include a display that is a graphical user interface configured to present visual information to a user using graphical objects. Examples of a display include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

A portion of the HVAC system 100 may be configured to move air across the evaporator unit 116 and out of the duct sub-system 122. Return air (such as airflow 118), which may be air returning from the building, fresh air from outside, or some combination, is pulled into a return duct 136. A variable-speed blower may pull the return air into the return duct 136 where the airflow 118 crosses the evaporator unit 116 or heating elements (not shown) to produce the treated airflow 120. In other embodiments, the one or more fans 126 of the evaporator unit 116 may direct the airflow 118 into return duct 136 and across the evaporator unit 116.

The HVAC system 100 may comprise one or more sensors 138 in signal communication with the controller 124. The sensors 138 may comprise any suitable type of sensor for measuring the air temperature. The sensors 138 may be positioned anywhere within a conditioned space (e.g. a room or building) and/or the HVAC system 100. For example, the HVAC system 100 may comprise a sensor 138 positioned and configured to measure an outdoor air temperature. As another example, the HVAC system 100 may comprise a sensor 138 positioned and configured to measure a supply or treated air temperature and/or a return air temperature. In other examples, the HVAC system 100 may comprise sensors 138 positioned and configured to measure any other suitable type of air temperature, pressure, humidity, or any other suitable parameter.

The HVAC system 100 may comprise one or more thermostats, for example, located within a conditioned space (e.g. a room or building). The thermostat may be a single-stage thermostat, a multi-stage thermostat, or any suitable type of thermostat as would be appreciated by one of ordinary skill in the art. The thermostat may be configured to allow a user to input a desired temperature or temperature set point for a designated space or zone such as the room.

Example Evaporator Unit of the HVAC System

Figure 2:
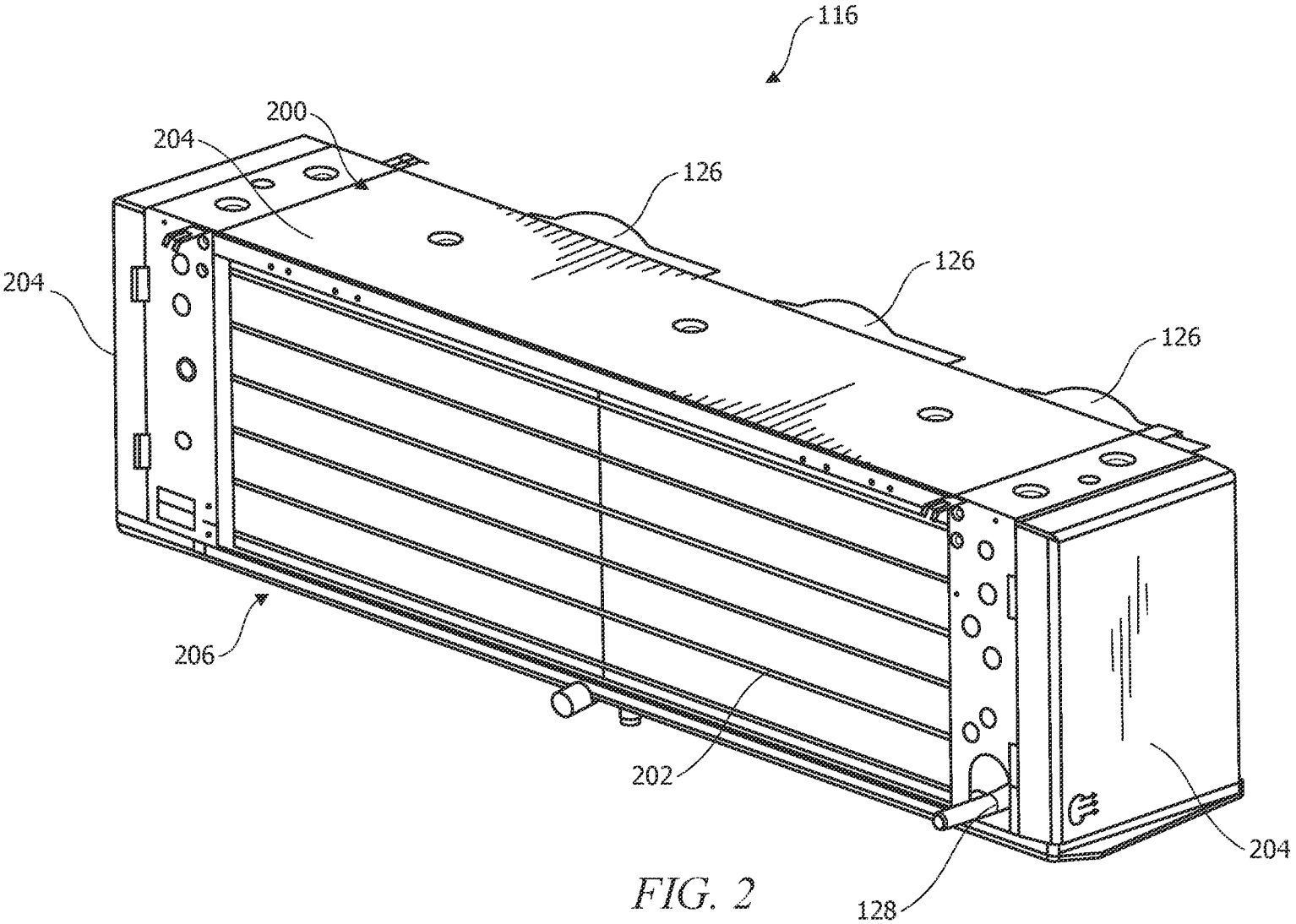
FIG. 2 is an embodiment of an air intake side of an evaporator unit of the HVAC system of FIG. 1.

FIG. 2 illustrates an embodiment of the evaporator unit 116 of the HVAC system 100. The evaporator unit 116 may comprise a housing 200, one or more evaporator coils 128, one or more fans 126, and a heater 202. The housing 200 may be operable to house and protect the internal components of the evaporator unit 116 (such as the one or more evaporator coils 128) from an external environment. The housing 200 may comprise any suitable size, height, shape, and any combinations thereof. Further, the housing 200 may comprise any suitable materials, such as metals, nonmetals, polymers, composites, and any combinations thereof.

As illustrated, the housing 200 may comprise a plurality of side panels 204. The plurality of side panels 204 may be coupled together through any suitable means to form the housing 200. In embodiments, the housing 200 may be at least partially open where one side of the housing 200 does not comprise a side panel 204 or at least provides fluid communication to an external environment. For example, an air intake side 206 of the evaporator unit 116 may be open with respect to the housing 200. In this example, the air intake side 206 does not have a side panel 204 and is open to receive an airflow (such as airflow 118 in FIG. 1). The air intake side 206 may be configured receive an airflow for exposure to the one or more evaporator coils 128, wherein the one or more evaporator coils 128 may transfer heat from the received airflow to a refrigerant flowing through the one or more evaporator coils 128 during a refrigeration cycle.

In certain embodiments, the evaporator unit 116 may comprise the heater 202 disposed proximate to the one or more evaporator coils 128. The heater 202 may be configured to provide heat to the one or more evaporator coils 128 during a defrost cycle. For example, as the HVAC system 100 determines that ice and/or frost build-up is present on the one or more evaporator coils 128, the heater 202 may be actuated to turn on and provide heat to remove the ice and/or frost build-up. In other embodiments, a hot gas defrost configuration may be utilized by the evaporator unit 116, wherein heated and pressurized refrigerant from further downstream of the evaporator unit 116 is directed to flow back to the evaporator unit 116 and through the one or more evaporator coils 128 to remove the ice and/or frost build-up during a defrost cycle. As illustrated, the heater 202 may be disposed along or accessibly by the air intake side 206 of the evaporator unit 116. In this example, the heat provided by the heater 202 may be exposed to a lower temperature ambient air as the one or more evaporator coils 128 may have previously transferred heat from airflow 118 to the refrigerant during a refrigeration cycle, thereby reducing the temperature of the airflow 118. Due to the surrounding lower temperature ambient air, the heater 202 may consume additional power for a longer time period to remove the ice and/or frost build-up on the one or more evaporator coils 128.

Figure 3:
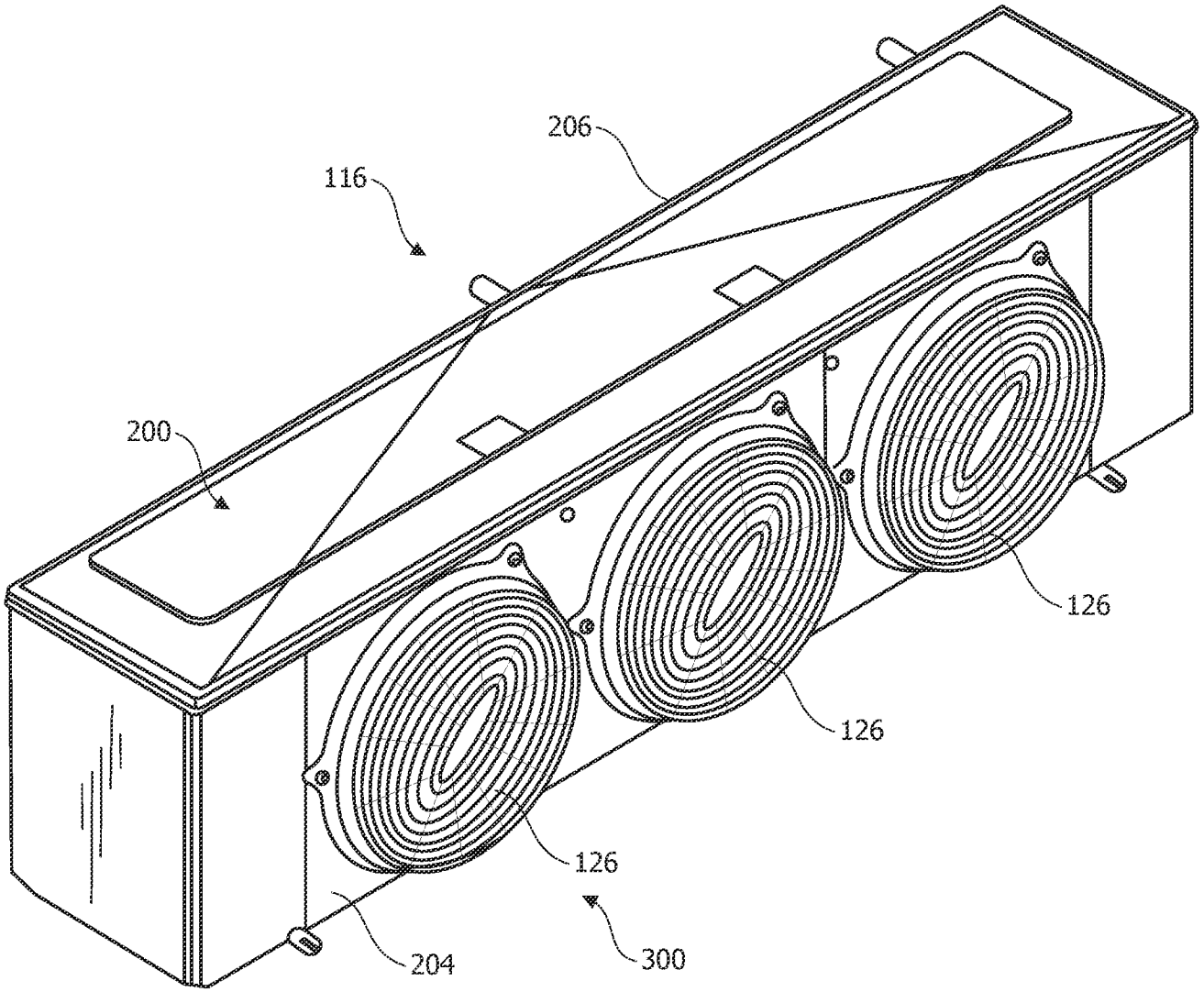
FIG. 3 is an embodiment of an air discharge side of an evaporator unit of the HVAC system of FIG. 1.

FIG. 3 illustrates another embodiment of the evaporator unit 116 of the HVAC system 100. FIG. 3 illustrates an isometric view of the evaporator unit 116 depicted in FIG. 2 showing an air discharge side 300 of the evaporator unit 116. As illustrated, the air discharge side 300 may be disposed opposite from the air intake side 206. The one or more fans 126 may be disposed on the air discharge side 300, wherein the one or more fans 126 may be configured to discharge the received airflow 118 (referring to FIG. 1) as the treated airflow 120 (referring to FIG. 1) after the one or more evaporator coils 128 (referring to FIG. 1) transfer heat from the airflow 118 to the refrigerant. In embodiments, the treated airflow 120 may have a lower temperature than the received airflow 118.

As illustrated, the air discharge side 300 may comprise one of the plurality of side panels 204 of the housing 200. Each of the one or more fans 126 may be disposed on top of or integrated with that one of the plurality of side panels 204. As the one or more fans 126 may be configured to discharge an airflow, the one or more fans 126 may provide fluid communication between an interior of the housing 200 and an exterior of the housing 200. During a defrost cycle, the one or more evaporator coils 128 may not need to perform heat transfer with the surrounding air, and the one or more fans 126 may be turned off. Although the one or more fans 126 may be turned off, ambient air may be permitted to flow into the air discharge side 300 to interact with the one or more evaporator coils 128 via the one or more fans 126.

Although a particular implementation of the evaporator unit 116 is illustrated and primarily described, the present disclosure contemplates any suitable implementation of evaporator unit 116, according to particular needs. Moreover, although various components of evaporator unit 116 have been depicted as being located at particular positions, the present disclosure contemplates those components being positioned at any suitable location, according to particular needs.

Figure 4A:
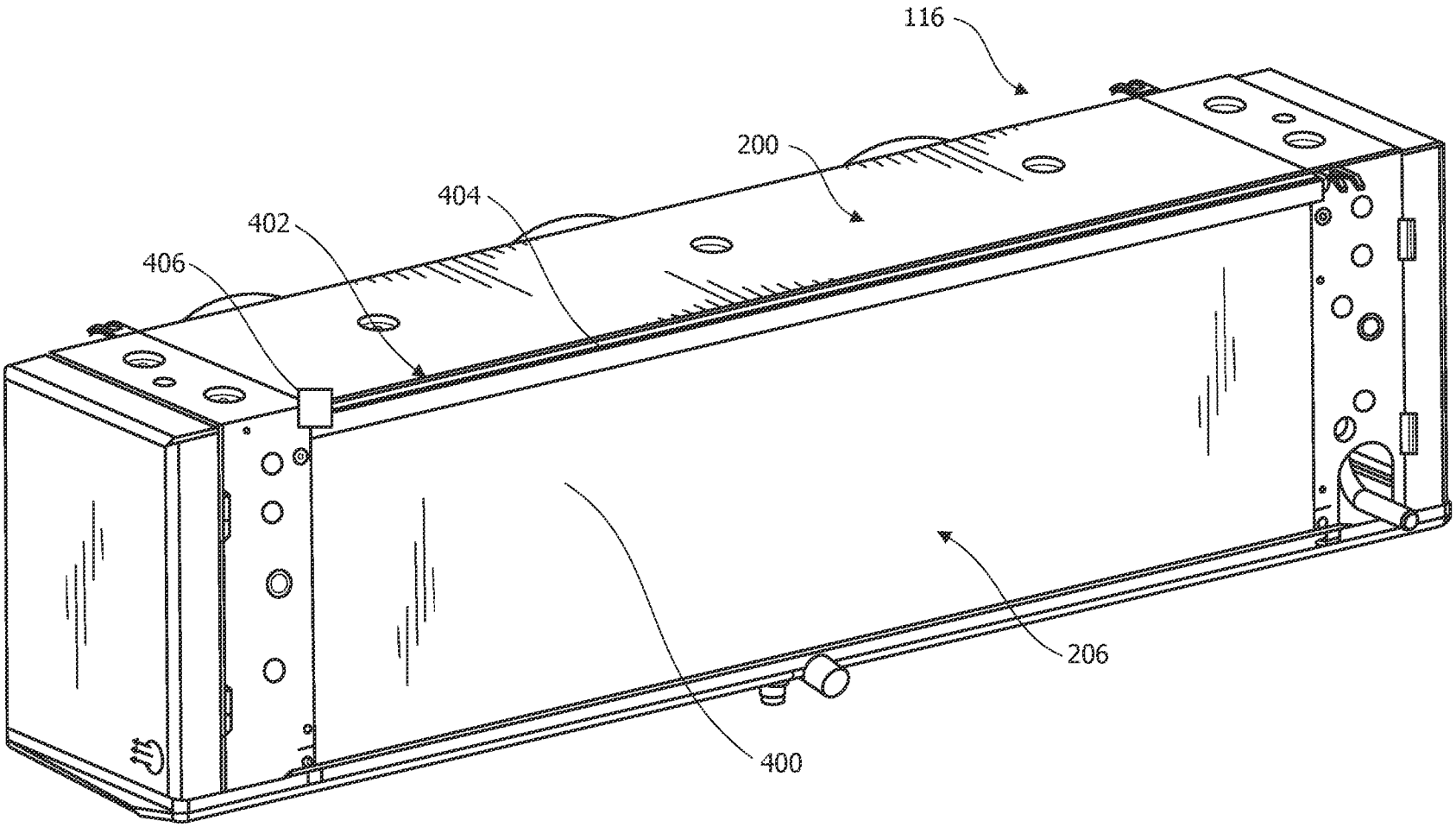
FIG. 4A is an embodiment of a first sealing structure for an evaporator unit.
Figure 4B:
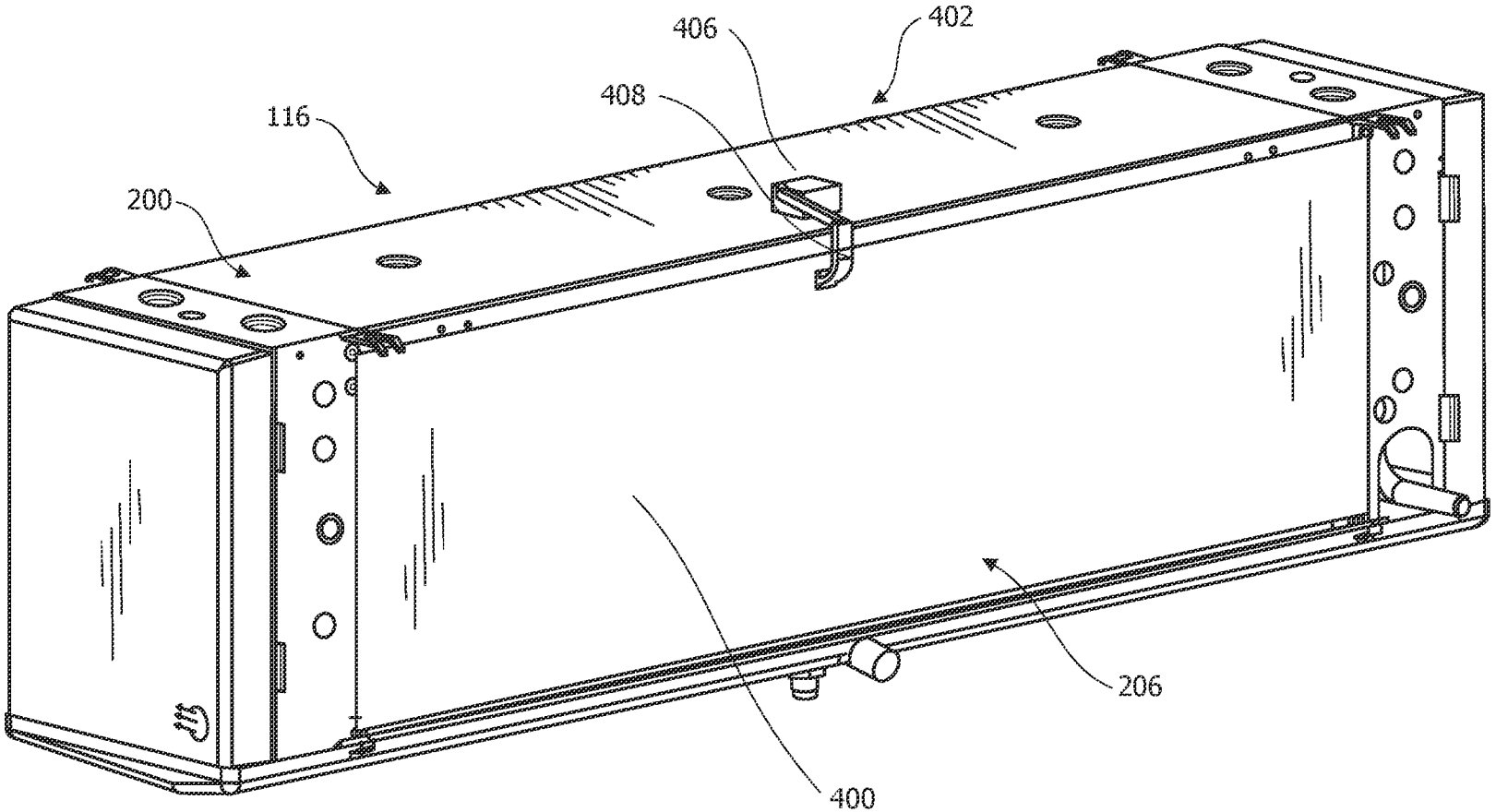
FIG. 4B is another embodiment of a first sealing structure for an evaporator unit.
Figure 4C:
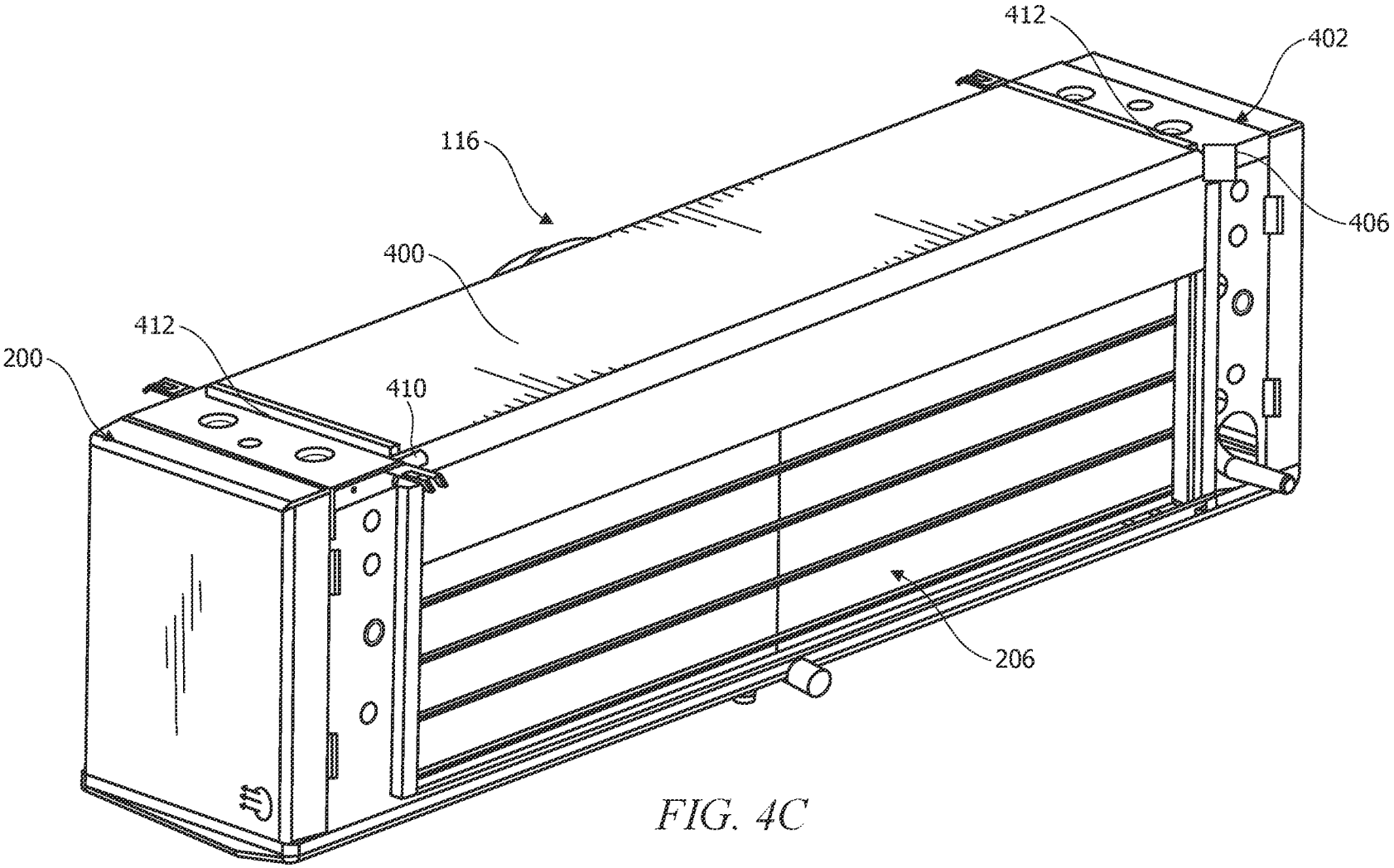
FIG. 4C is another embodiment of a first sealing structure for an evaporator unit.

FIGS. 4A-4C each illustrate an embodiment of a first sealing structure 400 for the evaporator unit 116. With reference to each of FIGS. 4A-4C, the first sealing structure 400 may be configured to seal the air intake side 206 of the evaporator unit 116 during a defrost cycle to prevent ambient air from entering the housing 200 through the air intake side 206 and interacting with the one or more evaporator coils 128 (referring to FIG. 1). The first sealing structure 400 may comprise any suitable size, height, shape, and any combinations thereof. Further, the first sealing structure 400 may comprise any suitable materials, such as metals, nonmetals, polymers, composites, and any combinations thereof. Without limitations, the first sealing structure 400 may comprise a polyvinyl chloride resin and/or an insulated metal foil.

The evaporator unit 116 may further comprise a first actuator 402 coupled to the first sealing structure 400 and operable to move the first sealing structure 400 between a first position and a second position. Any suitable assembly, equipment, and/or actuator may be used as the first actuator 402. For example, the first sealing structure 400 may be in the first position during a refrigeration cycle to allow airflow 118 (referring to FIG. 1) to be received by the evaporator unit 116 through the air intake side 206, wherein the air intake side 206 is uninhibited by the first sealing structure 400 in the first position. The air intake side 206 may be operable to receive the airflow 118 while the first sealing structure 400 is in the first position, wherein the first sealing structure 400 may leave at least a portion of the air intake side 206 exposed and open to receive to airflow 118. The first actuator 402 may be configured to move the first sealing structure 400 from the first position to a second position before the HVAC system 100 (referring to FIG. 1) performs a defrost cycle. In embodiments, the second position may be where the first sealing structure 400 is disposed over the air intake side 206 to prevent ambient air to enter the housing 200 through the air intake side 206.

With reference to FIG. 4A, the first sealing structure 400 may be a sheet of material similar to a curtain, and the first actuator 402 may be a roller assembly. In other embodiments, the first actuator 402 may be a sliding assembly. The first actuator 402 may comprise an enclosure 404, a roller (not shown), and a motor 406. The enclosure 404 may comprise any suitable size, height, shape, and any combinations thereof. For example, a length of the enclosure 404 may be approximately the same as the width of the air intake side 206. In other embodiments, the length of the enclosure 404 may be approximately the same as the height of the air intake side 206. The enclosure 404 may be configured to house the roller and the first sealing structure 400 disposed around the roller. In embodiments, the roller may be disposed within the enclosure 404 and operable to rotate within the enclosure 404. The first sealing structure 400 may be at least partially disposed around the roller, wherein the first sealing structure 400 is completely disposed around the roller in a first position and actuated to extend in a direction away from the roller in a second position. In embodiments, the motor 406 may be configured to actuate the roller to rotate, wherein the first sealing structure 400 may unwind and extend from the roller as the roller rotates. The first sealing structure 400 may extend to cover the air intake side 206.

As illustrated, the motor 406 may be coupled to an end of the roller. An opposing end of the roller may be configured to rotate freely. Any suitable driving mechanism may be used as the motor 406. Examples of motor 406 may include, but are not limited to, a direct current (DC) motor, an alternating current (AC) motor, or any other suitable type of electrical motor. For example, a motor 406 may be a DC motor that comprises a stator magnet, an armature conductor, a commutator, brushes, a winding, and/or any other suitable combination of components as would be appreciated by one of ordinary skill in the art. The motor 406 is configured to provide a rotational force in response to receiving an electrical signal, for example, a current signal or a voltage signal.

The first actuator 402 may be disposed along a top of the housing 200 and configured to extend the first sealing structure 400 in a downward direction to overlap with the air intake side 206. In alternate embodiments, the first actuator 402 may be disposed along a left side of the air intake side 206 and configured to extend the first sealing structure 400 in a righthand direction to cover the air intake side 206. In other embodiments, the first actuator 402 may be disposed along a right side of the air intake side 206 and configured to extend the first sealing structure 400 in a lefthand direction to cover the air intake side 206. In further embodiments, the first actuator 402 may be disposed along a bottom of the air intake side 206 and configured to extend the first sealing structure 400 in an upper direction to cover the air intake side 206.

With reference to FIG. 4B, the first sealing structure 400 may be a door, and the first actuator 402 may be a linkage assembly. In this embodiment, the first actuator 402 may comprise the motor 406 and a linkage 408. The linkage 408 may comprise any suitable size, height, shape, and any combinations thereof. The linkage 408 may couple the motor 306 to the first sealing structure 400. The linkage 408 may be secured to the first sealing structure 400 through any suitable means, including fasteners, adhesives, welding, brazing, and the like. During operation, the motor 406 may be actuated to provide rotational force to the linkage 408, wherein the first sealing structure 400 may rotate about the linkage 408 due to the rotational force. The motor 406 may force the first sealing structure 400 to rotate between the first position and the second position, wherein the second position is illustrated in FIG. 4B covering the air intake side 206.

With reference to FIG. 4C, the first sealing structure 400 may be a sheet of material similar to a curtain, and the first actuator 402 may be a roller assembly. FIG. 4C may illustrate an embodiment similar to that shown in FIG. 4A. In this embodiment, the first actuator 402 may comprise the motor 406, a roller 410, and a set of guide rails 412. The set of guide rails 412 may be disposed on opposing sides of the air intake side 206. The first sealing structure 400 may be at least partially inserted into the set of guide rails 412 to be disposed between the set of guide rails 412. The roller 410 may be disposed between the set of guide rails 412 and may function to move the first sealing structure along the set of guide rails 412. The roller 410 may operate similar to the roller described with reference to FIG. 4A. In this embodiments, the first sealing structure 400 may not be wrapped around the roller 410 in the first position but may be partially disposed against the roller 410. For example, the roller 410 may be actuated by the motor 406 to rotate. The first sealing structure 400 may be configured to contact at least a portion of a surface of the roller 410 wherein the roller 410 may transfer the rotational force to the first sealing structure 400. This force may cause the first sealing structure 400 to displace along the set of guide rails 412.

Figure 5A:
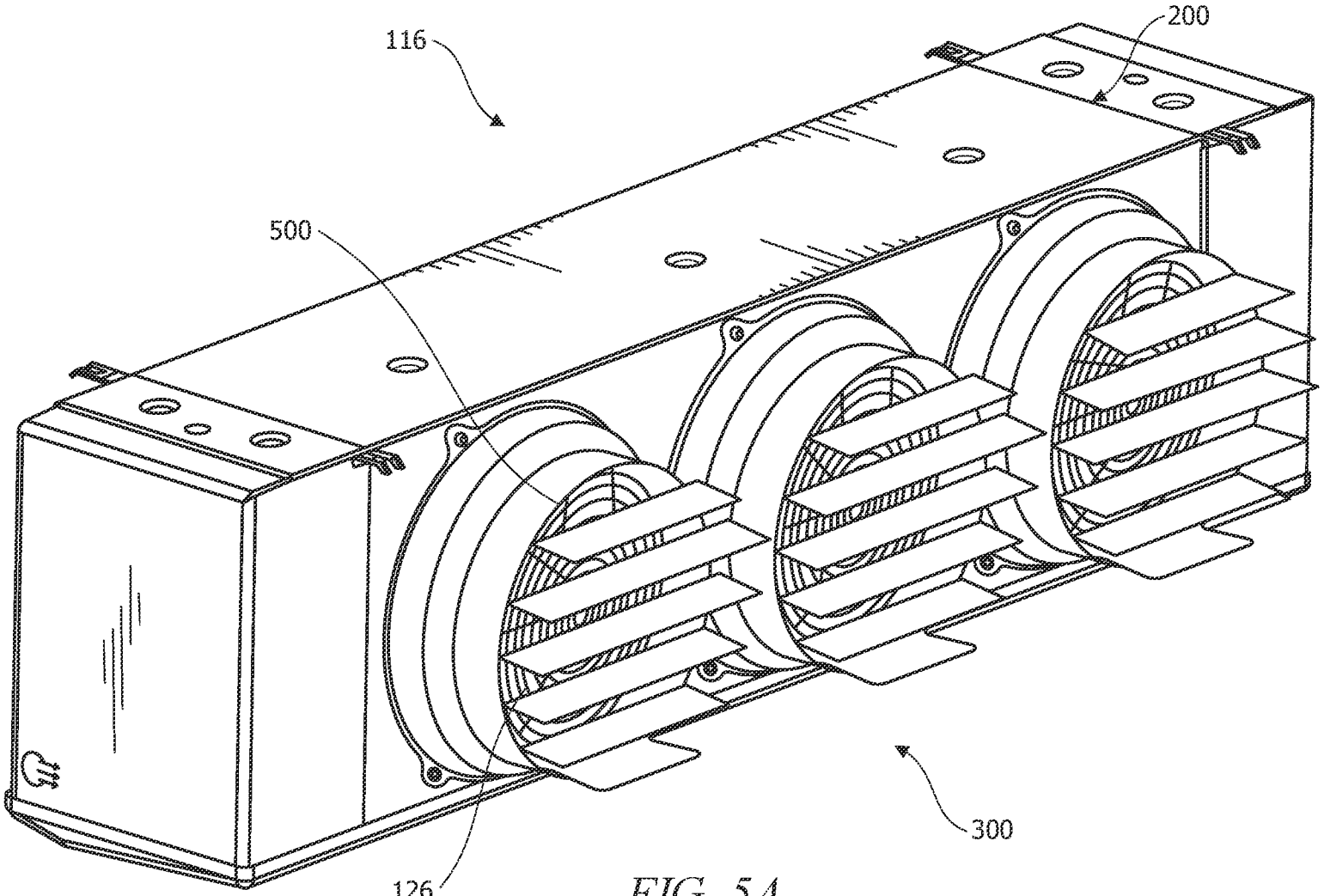
FIG. 5A is an embodiment of a second sealing structure for an evaporator unit.
Figure 5B:
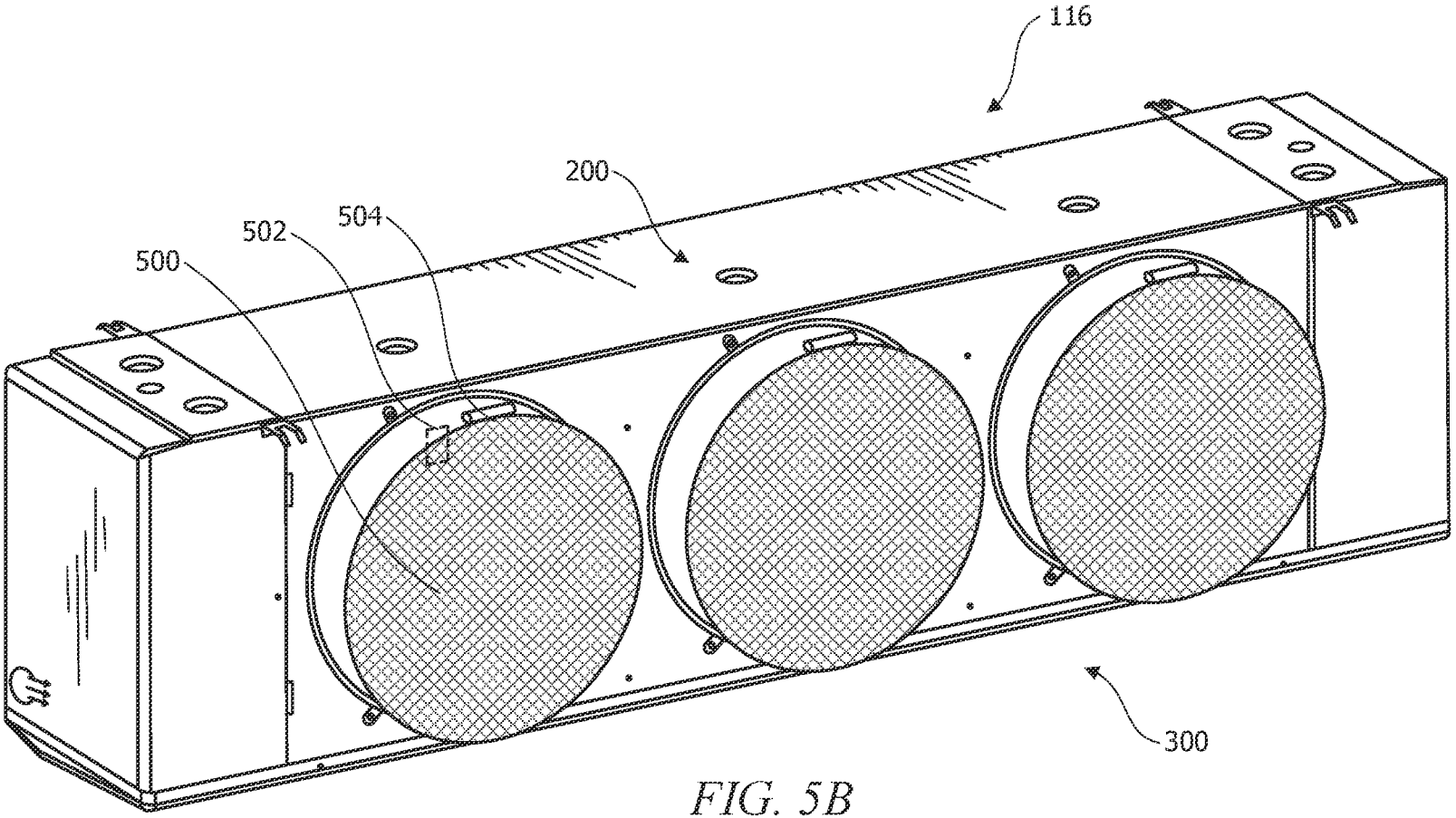
FIG. 5B is another embodiment of a second sealing structure for an evaporator unit.

FIGS. 5A-5B each illustrate an embodiment of a second sealing structure 500 of the evaporator unit 116. With reference to each of FIGS. 5A-5B, the second sealing structure 500 may be configured to seal the air discharge side 300 of the evaporator unit 116 during a defrost cycle to prevent ambient air from entering the housing 200 through the air discharge side 300 and interacting with the one or more evaporator coils 128 (referring to FIG. 1). The second sealing structure 500 may comprise any suitable size, height, shape, and any combinations thereof. Further, the second sealing structure 500 may comprise any suitable materials, such as metals, nonmetals, polymers, composites, and any combinations thereof.

With reference to FIG. 5A, the second sealing structure 500 may be a louver, and the evaporator unit 116 may comprise one or more second sealing structures 500. The louver may comprise any suitable number of horizontal slats having any suitable length and shape, wherein the horizontal slats may be actuated to open and close. In this embodiment, each second sealing structure 500 may be disposed over one of the one or more fans 126. FIG. 5A illustrates the second sealing structures 500 in a first position where air may flow through the air discharge side 300. During operations wherein the one or more fans 126 are turned on to discharge treated airflow 120 (referring to FIG. 1), the pressure of the treated airflow 120 flowing into the second sealing structures 500 may force the second sealing structures 500 open, thereby allowing the treated airflow 120 to be discharged out of the evaporator unit 116. When the one or more fans 126 are turned off, such as during a defrost cycle, the second sealing structures 500 may be closed. In this example, there is no pressure provided by the treated airflow 120 to keep the second sealing structures 500 open, and the second sealing structures 500 transition to a closed, second position. As the second sealing structures 500 may not require actuation by an external component, the second sealing structures 500 may be zero-pressure drop louvers.

In certain embodiments, the second sealing structure 500 may be actuated to move by a second actuator. FIG. 5B illustrates an embodiment of the evaporator unit 116 using a second actuator 502. The second actuator 502 may be operable to move the second sealing structure 500 between an open, first position and a closed, second position. Any suitable assembly, equipment, and/or actuator may be used as the second actuator 502. For example, similar to the first sealing structure 400 (referring to FIGS. 4A-4C), the second sealing structure 500 may be in the first position during a refrigeration cycle to allow treated airflow 120 (referring to FIG. 1) to be discharged by the evaporator unit 116 through the air discharge side 300 via one or more fans 126 (referring to FIG. 1), wherein an interior and exterior of the housing is fluidly accessible via the air discharge side 300. The second actuator 502 may be configured to move the second sealing structure 500 from the first position to a second position before the HVAC system 100 (referring to FIG. 1) performs a defrost cycle. In embodiments, the second position may be where the second sealing structure 500 covers the one or more fans 126 to prevent ambient air to enter the housing 200 through the air discharge side 300.

With reference to FIG. 5B, the second sealing structure 500 may be a door, and the second actuator 502 may be a motor (similar to motor 406). As illustrated, the second actuator 502 may be disposed internal to each fan 126 and second sealing structure 500. In other embodiments, the second actuator 502 may be disposed about any suitable location proximate the second sealing structure 500. In this embodiment, each second sealing structure 500 may be coupled to one of the one or more fans 126 via a hinge 504. In other embodiments, there may be two second sealing structures 500 coupled to each fan 126 through respective hinges 504. During operation, the second actuator 502 may be actuated to provide rotational force to a suitable linkage connecting the second actuator 502 to the second sealing structure 500, wherein the second sealing structure 500 may rotate about the hinge 504 due to the rotational force. The second actuator 502 may force the second sealing structure 500 to rotate between the first position and the second position, wherein the second position is illustrated in FIG. 5B covering each of the one or more fans 126 on the air discharge side 300 of the evaporator unit 116.

Example Operation of the HVAC System

FIG. 6 is a flowchart of an embodiment of a process 600 for the HVAC system 100. The HVAC system 100 may employ process 600 for operating first sealing structure 400 (referring to FIGS. 4A-4C) and second sealing structure 500 (referring to FIGS. 5A-5B) of the evaporator unit 116 (referring to FIG. 1) while operating the HVAC system 100. At operation 602, processor 130 (referring to FIG. 1) of the controller 124 (referring to FIG. 1) may operate the HVAC system 100 in a first mode of operation. For example, the first mode of operation may be a refrigeration cycle or a heat pump cycle. The processor 130 may transmit instructions to turn on the one or more fans 126 (referring to FIG. 1), the compressor 106 (referring to FIG. 1), the fan 110 (referring to FIG. 1), and any combination thereof. Operation of the aforementioned components may enable heat transfer between the refrigerant flowing within the working-fluid conduit subsystem 102 (referring to FIG. 1) and either the condenser 108 (referring to FIG. 1) or the evaporator unit 116.

At operation 604, the processor 130 of the controller 124 may determine whether or not the HVAC system 100 is transitioning from the first mode of operation to a second mode of operation, wherein the second mode of operation is a defrost cycle. In an example, the HVAC system 100 may be operating and ice and/or frost may build-up on the one or more evaporator coils 128 (referring to FIG. 1). In this example, the HVAC system 100 may receive a command through user input to initiate a defrost cycle, initiate a defrost cycle periodically, or initiate a defrost cycle once a pre-determined amount of ice and/or frost has built-up on the one or more evaporator coils 128. If the processor 130 determines that the HVAC system 100 is not transitioning to the second mode of operation, the process 600 proceeds back to operation 602. Otherwise, the process 600 proceeds to operation 606.

At operation 606, the processor 130 of the controller 124 may actuate both the first sealing structure 400 and the second sealing structure 500 to transition from a first position to a second position. Here, the first position for the first sealing structure 400 refers to a position wherein the air intake side 206 (referring to FIG. 2) is uninhibited by the first sealing structure 400 and able to allow fluid communication through the air intake side 206. The second position refers to a position covering the air intake side 206 to prevent airflow through the air intake side 206. Similarly, the first position for the second sealing structure 500 refers to a position wherein the air discharge side 300 (referring to FIG. 3) is uninhibited by the second sealing structure 500 and able to allow fluid communication through the air discharge side 300. The second position refers to a position covering the air discharge side 300 to prevent airflow through the air discharge side 300. The processor 130 may transmit an instruction to actuate the first actuator 402 (referring to FIGS. 4A-4C) coupled to the first sealing structure 400 to move the first sealing structure 400 to the second position. In certain embodiments, the processor 130 may further transmit an instruction to actuate the second actuator 502 (referring to FIG. 5B) coupled to the second sealing structure 500 to move the first sealing structure 500 to the second position. In other embodiments, the second sealing structure 500 may be operable to transition between the first and second positions without application of an external force.

At operation 608, the processor 130 of the controller 124 may transmit instructions to turn off one or more components in the HVAC system 100 to facilitate the defrost cycle. For example, the one or more fans 126, the compressor 106, and the fan 110 may be communicatively coupled to the controller 124 and may be operable to perform a refrigeration cycle. During the defrost cycle, the HVAC system 100 may not require airflow to be produced by the one or more fans 126 or the fan 110 and may not require pressurization of refrigerant by the compressor 106. The processor 130 may instruct the one or more fans 126, the compressor 106, and the fan 110 to turn off during the second mode of operation.

At operation 610, the processor 130 of the controller 124 may determine whether or not the HVAC system 100 is transitioning from the second mode of operation back to the first mode of operation. In an example, the HVAC system 100 may be operating a defrost cycle to remove ice and/or frost build-up on the one or more evaporator coils 128 during the second mode of operation. At the end of the defrost cycle, the HVAC system 100 may continue to operate a refrigeration cycle or a heat pump cycle or may be turned off. In this example, the HVAC system 100 may receive a command through user input to operate in the first mode of operation or initiate operation in the first mode of operation once a pre-determined amount of ice and/or frost has been removed from the one or more evaporator coils 128. If the processor 130 determines that the HVAC system 100 is transitioning back to the first mode of operation, the process 600 proceeds to operation 612. Otherwise, the process 600 proceeds to end.

At operation 612, the processor 130 of the controller 124 may actuate both the first sealing structure 400 and the second sealing structure 500 to transition from the second position back to the first position. Similar to operation 606, the processor 130 may further transmit an instruction to actuate the first actuator 402 and/or the second actuator 502 to move the first sealing structure 400 and the second sealing structure 500, respectively, back to the first position. The process 600 may proceed back to operation 602, wherein the HVAC system 100 may operate in the first mode of operation. The process 600 may continue to repeat until the HVAC system 100 does not transition from the second mode of operation to the first mode of operation in operation 610, wherein the process 600 may then proceed to end.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A heating, ventilation, and air conditioning (HVAC) system, comprising:

an evaporator unit, comprising:

a housing configured to contain an evaporator coil, the housing comprising an air intake side and an air discharge side;

a first sealing structure disposed along the housing;

a first actuator coupled to the first sealing structure and operable to move the first sealing structure between a first position and a second position;

the evaporator coil configured to receive an airflow and to transfer heat from the received airflow to a flow of refrigerant; and a fan disposed downstream of the evaporator coil configured to introduce the airflow into the housing;

a compressor configured to receive the flow of refrigerant from the evaporator coil and to discharge the flow of refrigerant at a higher pressure;

a condensing unit comprising a condenser configured to receive the flow of refrigerant from the compressor and to reduce a temperature of the flow of refrigerant; and a controller operably coupled to the evaporator unit, comprising:

a processor, configured to:

determine if the HVAC system is transitioning from a first mode of operation to a second mode of operation, wherein the first sealing structure is in the first position during the first mode of operation; and in response to determining that the HVAC system is transitioning from the first mode of operation to the second mode of operation, actuate the first actuator to move the first sealing structure to the second position, wherein the second position is configured to seal the air intake side of the housing;

wherein during the second mode of operation:

the compressor is turned off; and the fan is turned off.

2. The HVAC system of claim 1, wherein the evaporator unit further comprises a second sealing structure disposed along the air discharge side of the housing operable to selectively seal the air discharge side of the housing.

3. The HVAC system of claim 2, wherein the second sealing structure is a zero-pressure drop louver configured to seal the air discharge side of the housing when the fan is turned off.

4. The HVAC system of claim 2, wherein the evaporator unit further comprises a second actuator coupled to the second sealing structure and operable to move the second sealing structure between a third position and a fourth position.

5. The HVAC system of claim 1, wherein the first actuator is disposed on top of the housing and is coupled to the first sealing structure through a linkage, wherein the first sealing structure is operable to rotate between the first position and the second position through the coupling between the linkage and the first actuator.

6. The HVAC system of claim 1, wherein the evaporator unit further comprises a set of guide rails disposed on top of the housing and on the air intake side of the housing, wherein the first sealing structure is disposed between the set of guide rails and the housing, wherein the first sealing structure is configured to translate between the first position and the second position along the set of guide rails.

7. The HVAC system of claim 1, wherein the processor is further configured to:

determine if the HVAC system is transitioning from the second mode of operation to the first mode of operation; and in response to determining that the HVAC system is transitioning from the second mode of operation to the first mode of operation, actuate the first actuator to move the first sealing structure from the second position to the first position to allow airflow through the air intake side of the housing.

8. A method of operating a heating, ventilation, and air conditioning (HVAC) system, comprising:

operating the HVAC system in a first mode of operation, wherein operating the HVAC system in the first mode of operation comprises sending a command to actuate an evaporator coil contained in an evaporator unit and a compressor;

determining if the HVAC system is transitioning from a first mode of operation to a second mode of operation, wherein a first sealing structure coupled to the evaporator unit is in a first position during the first mode of operation; and in response to determining that the HVAC system is transitioning from the first mode of operation to the second mode of operation, actuating a first actuator to move the first sealing structure from the first position to a second position, wherein the second position is configured to seal an air intake side of a housing of the evaporator unit; and operating the HVAC system in the second mode of operation, wherein the compressor is turned off during the second mode of operation.

9. The method of claim 8, wherein the evaporator unit further comprises a second sealing structure disposed along an air discharge side of the housing operable to selectively seal the air discharge side of the housing.

10. The method of claim 9, wherein the second sealing structure is a zero-pressure drop louver configured to seal the air discharge side of the housing when a fan associated with the evaporator unit is turned off.

11. The method of claim 9, further comprising actuating a second actuator to move the second sealing structure between a third position and a fourth position.

12. The method of claim 8, wherein the first actuator is disposed on top of the housing and is coupled to the first sealing structure through a linkage, wherein the first sealing structure is operable to rotate between the first position and the second position through the coupling between the linkage and the first actuator.

13. The method of claim 8, further comprising:

determining if the HVAC system is transitioning from the second mode of operation to the first mode of operation; and in response to determining that the HVAC system is transitioning from the second mode of operation to the first mode of operation, actuating the first actuator to move the first sealing structure from the second position to the first position to allow airflow through the air intake side of the housing.

14. An evaporator unit, comprising:

a housing configured to contain an evaporator coil, the housing comprising an air intake side and an air discharge side;

a first sealing structure disposed along the housing;

a first actuator coupled to the first sealing structure and operable to move the first sealing structure between a first position and a second position;

the evaporator coil configured to receive an airflow and to transfer heat from the received airflow to a flow of refrigerant;

a fan disposed downstream of the evaporator coil configured to introduce the airflow into the housing; and a second sealing structure disposed along the air discharge side of the housing operable to selectively seal the air discharge side of the housing.

15. The evaporator unit of claim 14, wherein the second sealing structure is a zero-pressure drop louver configured to seal the air discharge side of the housing when the fan is turned off.

16. The evaporator unit of claim 14, further comprising a second actuator coupled to the second sealing structure and operable to move the second sealing structure between a third position and a fourth position.

17. The evaporator unit of claim 16, further comprising at least one hinge coupling the second sealing structure to the air discharge side, wherein the second actuator is configured to actuate the second sealing structure to rotate about the at least one hinge between the third position and the fourth position.

18. The evaporator unit of claim 14, wherein the first actuator is disposed on top of the housing and is coupled to the first sealing structure through a linkage, wherein the first sealing structure is operable to rotate between the first position and the second position through the coupling between the linkage and the first actuator.

19. The evaporator unit of claim 14, further comprising a set of guide rails disposed on top of the housing and on the air intake side of the housing, wherein the first sealing structure is disposed between the set of guide rails and the housing, wherein the first sealing structure is configured to translate between the first position and the second position along the set of guide rails.

* * * * *